US008875654B2

(12) United States Patent
Hara et al.

(10) Patent No.: US 8,875,654 B2
(45) Date of Patent: Nov. 4, 2014

(54) APPARATUS FOR MANUFACTURING CYLINDRICAL MEMBER AND METHOD OF MANUFACTURING CYLINDRICAL MEMBER

(75) Inventors: Yuji Hara, Kanagawa (JP); Arimichi Fukuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 944 days.

(21) Appl. No.: 12/543,030

(22) Filed: Aug. 18, 2009

(65) Prior Publication Data

US 2010/0247741 A1 Sep. 30, 2010

(30) Foreign Application Priority Data

Mar. 25, 2009 (JP) ..... 2009-073781

(51) Int. Cl.

| | |
|---|---|
| ***B05C 11/00*** | (2006.01) |
| ***B05C 11/10*** | (2006.01) |
| ***G03G 15/16*** | (2006.01) |
| ***G03G 15/02*** | (2006.01) |
| ***G03G 15/08*** | (2006.01) |

(52) U.S. Cl.

CPC ..... *G03G 15/0233* (2013.01); *B05C 11/1015* (2013.01); *G03G 15/1685* (2013.01); *G03G 15/0818* (2013.01)

USPC ..... 118/712; 118/209; 118/663; 118/665; 118/713

(58) Field of Classification Search

CPC ..... B05C 11/1015

USPC ..... 118/209–233, 663, 665, 712, 713, 118/DIG. 11

See application file for complete search history.

(56) References Cited

U.S. PATENT DOCUMENTS

| | | | | |
|---|---|---|---|---|
| 5,445,774 | A * | 8/1995 | Scribner | 264/40.5 |
| 5,866,194 | A * | 2/1999 | Ogawa et al. | 118/232 |
| 2004/0041304 | A1 * | 3/2004 | Willden et al. | 264/324 |

FOREIGN PATENT DOCUMENTS

| | | |
|---|---|---|
| JP | A-8-292676 | 11/1996 |
| JP | A-2005-88272 | 4/2005 |
| JP | A-2006-218844 | 8/2006 |
| JP | A-2006-264187 | 10/2006 |
| JP | A-2007-152205 | 6/2007 |
| JP | A-2008-49567 | 3/2008 |
| JP | 2009 056748 A * | 3/2009 |
| JP | A-2009-56748 | 3/2009 |
| JP | A-2009-178960 | 8/2009 |

OTHER PUBLICATIONS

Japanese Office Action issued in Japanese Patent Application No. 2009-073781 on Jan. 5, 2011 (with translation).

* cited by examiner

*Primary Examiner* — Dah-Wei D Yuan
*Assistant Examiner* — Stephen Kitt
(74) *Attorney, Agent, or Firm* — Oliff PLC

(57) ABSTRACT

The invention provides an apparatus for manufacturing a cylindrical member comprising a cylindrical core body having an outer peripheral surface with a releasing property, the apparatus comprising: a film-forming device that forms a resin film in a region at a central portion from both ends in the axial direction of the outer peripheral surface of the core body; a judging device that judges the deterioration of the releasing property of regions continuous from the region where the resin film is to be formed in the region at the inner side from both ends in the axial direction of the outer peripheral surface of the core body, before the resin film is formed by the film-forming device; and a control device that controls the film-forming device such that the resin film is formed by exposing regions with an undeteriorated releasing property on both ends in the axial direction of the outer peripheral surface of the core body, in accordance with the results of judgment by the judging device.

5 Claims, 10 Drawing Sheets

APPARATUS FOR MANUFACTURING CYLINDRICAL MEMBER AND METHOD OF MANUFACTURING CYLINDRICAL MEMBER

CROSS-REFERENCE TO RELATED APPLICATION

This application is based on and claims priority under 35 USC 119 from Japanese Patent Application No. 2009-073781 filed on Mar. 25, 2009.

BACKGROUND

1. Technical Field

The present invention relates to an apparatus for manufacturing a cylindrical member and a method of manufacturing the cylindrical member.

2. Related Art

In electrophotographic apparatuses such as an electrophotographic image forming apparatus and the like, a number of cylindrical members are used. For example, a charging roll as a charging member, a development roll as a developing device, and a transfer belt and a transfer roll as a transfer device, a fixing roll as a fixing device and the like are used.

If such a cylindrical member has a seam, there may be the case where the deterioration of an image quality to be formed arises, and therefore, seamless members have been preferably used.

SUMMARY

According to an aspect of the invention, there is provided an apparatus for manufacturing a cylindrical member comprising a cylindrical core body having an outer peripheral surface with a releasing property, the apparatus comprising: a film-forming device that forms a resin film in a region at a central portion from both ends in the axial direction of the outer peripheral surface of the core body; a judging device that judges the deterioration of the releasing property of regions continuous from the region where the resin film is to be formed in the region at the inner side from both ends in the axial direction of the outer peripheral surface of the core body, before the resin film is formed by the film-forming device; and a control device that controls the film-forming device such that the resin film is formed by exposing regions with an undeteriorated releasing property on both ends in the axial direction of the outer peripheral surface of the core body, in accordance with the results of judgment by the judging device.

BRIEF DESCRIPTION OF THE DRAWINGS

Exemplary embodiments of the invention will be described in detail based on the following figures, wherein.

DETAILED DESCRIPTION

Hereinafter, exemplary embodiments according to the invention will be described in detail with reference to the drawings.

Figure 1:
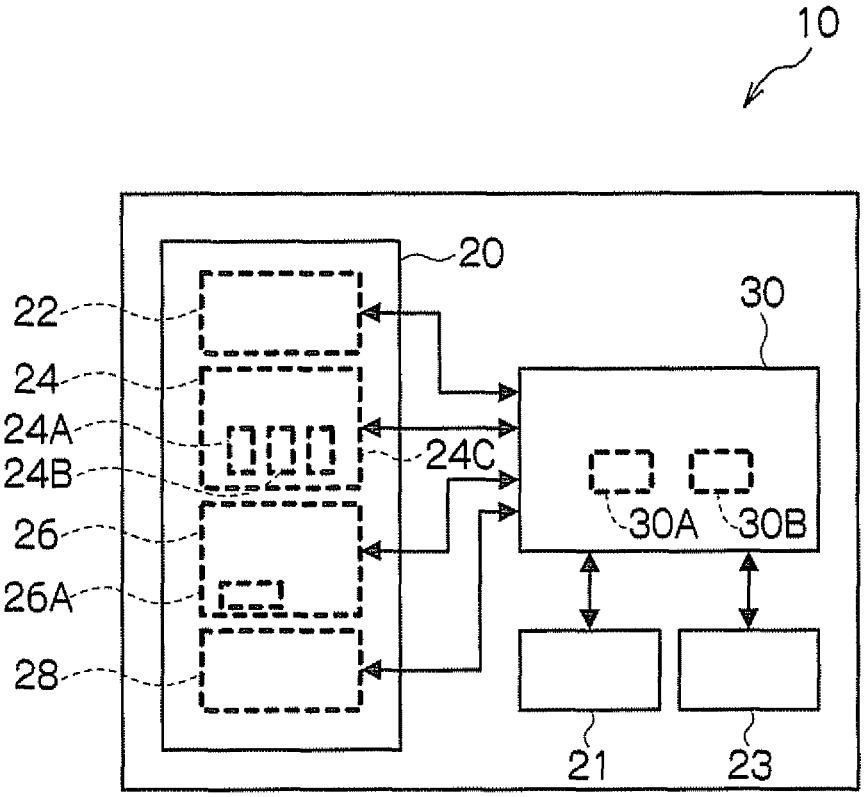
FIG. 1 is a schematic structural drawing showing an aspect of an apparatus for manufacturing a cylindrical member according to an exemplary embodiment of the invention.
Figure 2A:
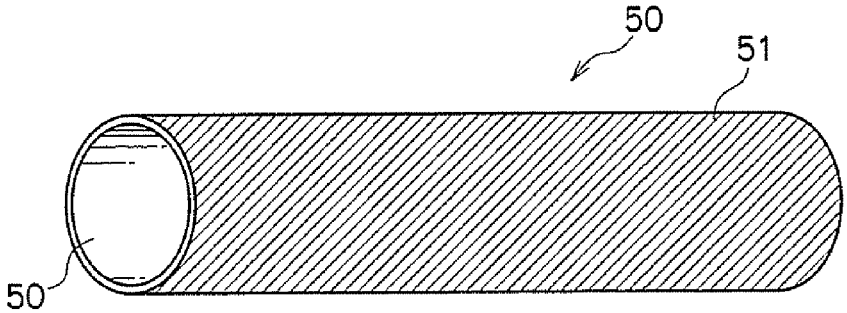
FIG. 2A is a schematic drawing showing a core body used in the apparatus for manufacturing a cylindrical member according to an exemplary embodiment of the invention.
Figure 2B:
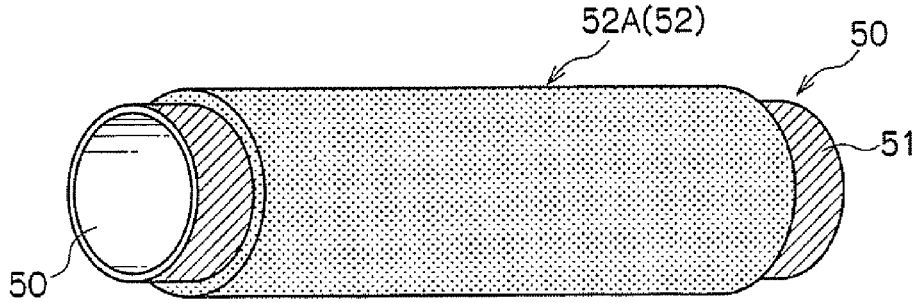
FIG. 2B is a schematic drawing showing a state where a coating film is formed on a core body.
Figure 2C:
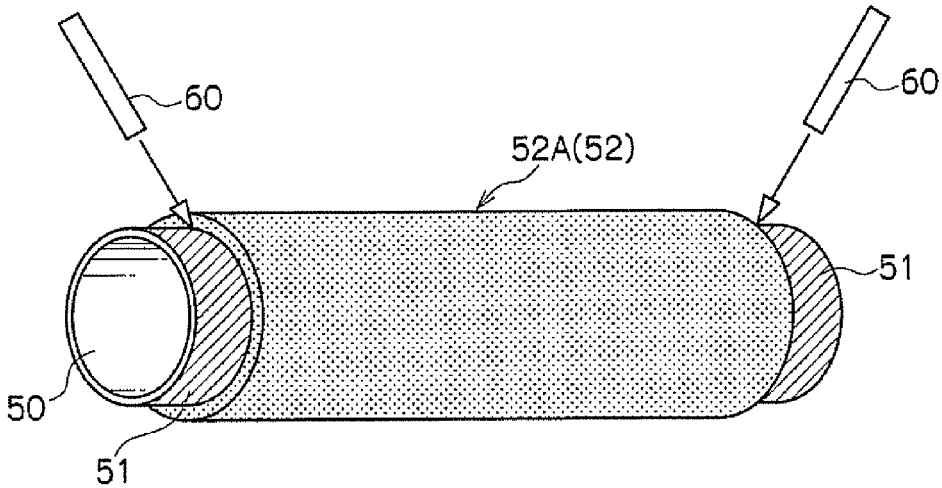
FIG. 2C is a schematic drawing showing a step of removing a baked coating film.
Figure 2D:
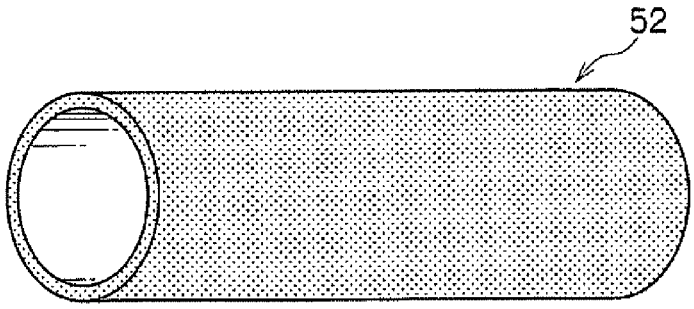
FIG. 2D is a schematic drawing showing a manufactured cylindrical member.

As shown in FIG. 1, a manufacturing apparatus 10 for a cylindrical member of the present exemplary embodiment (hereafter, the apparatus is referred to as a "cylindrical member manufacturing apparatus") is an apparatus for manufacturing a cylindrical member 52 (refer to FIG. 2D).

The cylindrical member 52 manufactured by the cylindrical member manufacturing apparatus 10 is an endless tubular body which is used suitably for the photoreceptor in an electrophotographic copier, a laser beam printer and the like; an intermediate transfer belt, an intermediate transfer body, a conveyer belt, a charging roll, a transfer roll, a development roll and the like; and the material, shape, size and the like thereof can be appropriately selected in accordance with the use, function or the like.

As shown in FIG. 2A, in the cylindrical member manufacturing apparatus 10, first, a core body 50 is prepared, and a releasing agent is coated over the entire outer peripheral surface of the core body to form a releasing layer 51, thereby forming a state where the outer peripheral surface of the core body 50 has a releasing property.

Next, a coating film 52A is formed by coating a resin solution onto the outer peripheral surface of the core body 50 (refer to FIG. 2B). After the coating film 52A is formed, the coating film 52A is baked at a predetermined baking temperature. As shown in FIG. 2C, air is injected between both ends in the axial direction of the baked coating film 52A from an air injection member 60 to form a clearance between the coating film 52A and the outer peripheral surface of the core body 50, then the baked coating film 52A is released and drawn out from the core body 50 so that a cylindrical member 52 is manufactured as shown in FIG. 2D.

Hereinafter, the structure of the cylindrical member manufacturing apparatus 10 will be described in detail.

The cylindrical member manufacturing apparatus 10 is constituted by including a cylindrical member manufacturing section 20 for manufacturing the cylindrical member 52 and a control section 30 for controlling the cylindrical member manufacturing section 20, as shown in FIG. 1. The cylindrical member manufacturing section 20 is constituted by including an identification section 22, a film-forming section 24, a baking section 26 and a releasing section 28. The identification section 22, the film-forming section 24, the baking section 26 and the releasing section 28 are connected to a control section 30, respectively, to enable transmission and reception of signals.

Further the cylindrical member manufacturing apparatus 10 includes an output unit 23 and an input unit 21. The output unit 23 and the input unit 21 are also connected to the control section 30, respectively, to enable transmission and reception of signals. The output unit 23 is an output device for displaying information inputted from the control section 30 to the outside, and examples of the output unit 23 include a display device such as a CRT and LCD, a printer, and the like. The input unit 21 is used as a command operation for inputting a variety of information, and examples of the input unit 21 include a keyboard and the like.

The identification section 22 is a device which reads identification information for identifying the core body 50. The identification section 22 may be any of identification information-readable devices, and when the display mode of identification information to be identified is a bar code, a bar code reader may be used, and the display mode is characters or numerals, a device having a character-recognizing function and an image pickup element may be used, and the devices may be appropriately selected in accordance with display modes.

Figure 3:
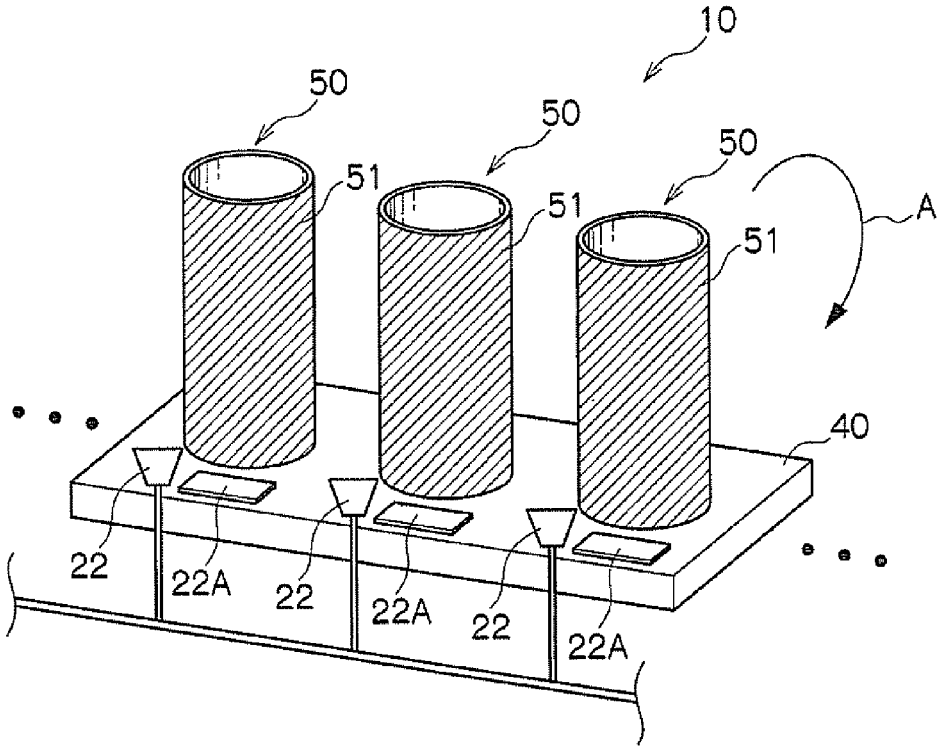
FIG. 3 is a schematic drawing showing a state where core bodies are placed on a seat in an apparatus for manufacturing a cylindrical member.

As shown in FIG. 3, in the cylindrical member manufacturing apparatus 10 of the exemplary embodiment, the core body 50 having a releasing layer 51 on the surface thereof is secured onto a seat 40 in an upright state with a securing member (that are not shown in the drawing). In the exemplary embodiment, although the case where three core bodies 50 are secured onto the seat 40 is exemplary described, the case is not limited to three core bodies. Further, although drawings are omitted, plural seats 40, onto which plural core bodies 50 are secured, are installed in the cylindrical member manufacturing apparatus 10.

Metals such as aluminum, nickel and stainless steel are used for the core body 50. In addition, the outer peripheral surface of the core body 50 is preferably roughened, from the viewpoint of preventing the coating film 52A from blistering under the influence of byproducts such as residual solvent or water in the coating film 52A when the coating film 52A formed on the outer peripheral surface of the core body 50 is dried.

Specifically, it is desirable that the arithmetic average roughness Ra of the outer peripheral surface is roughened in the range of from 0.2 μm to 2.0 μm. In the case where the outer peripheral surface of the core body 50 is roughened in the above range, vapor of residual solvent or water generated from the coating film 52A when the coating film 52A formed on the surface of the core body 50 is dried and baked, is released from small clearances between the core body 50 and the coating film 52A to the outside. Accordingly occurrence of blisters in the coating film can be prevented.

Examples of methods of the surface roughening of the outer peripheral surface of the core body 50 include blasting, cutting, sandpapering and the like. In order to make the interior surface of the coating film 52A into a spherical convex shape, in particular, it is desirable that the outer peripheral surface of the core body 50 is blast-processed with the use of spherical grains. The blast processing using spherical grains is a method of spraying grains containing glass, alumina, zirconia or the like having a diameter of about 0.1 mm to about 1 mm onto the core body with compressed air. If amorphous alumina grains (for example, general polishing grains) are used as the grains, since the configuration of the outer peripheral surface of the core body 50 also becomes amorphous, and in particular, protrusions and recesses with acute angles are easily formed, protrusions and recesses with acute angles are also formed on the inner peripheral surface of the cylindrical member 52 to be formed, which is not preferable.

The releasing layer 51 is formed on the outer peripheral surface of the core body 50 before the core body 50 is mounted on the seat 40 of the cylindrical member manufacturing apparatus 10. The releasing layer 51 is formed by applying a releasing agent uniformly over the entire outer peripheral surface of the core body 50. Accordingly, the entire region of the outer peripheral surface of the core body 50 is in a state having a releasing property. Releasing agents having a heat-resistance provided by modifying a silicone-based oil or fluorine-based oil are effective. Further, an aqueous releasing agent formed by dispersing ultrafine particles of a silicone resin in water may be used. The releasing layer 51 is formed by coating the releasing agent on the outer peripheral surface of the core body 50, and allowing a solvent to dry as is, or by further conducting baking after the releasing agent is coated.

The core bodies 50 having the releasing layer 51 formed on outer peripheral surface thereof are placed on the seat 40, and identification plates 22A, on which identification information for identifying each core body 50 placed on the seat 40 is recorded, are arranged at positions corresponding to the respective core bodies 50. In the exemplary embodiment, a bar code is recorded on the identification plate 22A as identification information for identifying each core body 50.

Each bar code recorded on the identification plate 22A is read by the identification section 22 arranged at the position corresponding to each plate. In addition, in the exemplary embodiment, when the core body 50, on the surface of which the releasing layer 51 is formed, is mounted on the seat 40, the seat 40 is conveyed by a conveying device (that is not shown in the drawing) to the position where the identification plate 22A is read by the identification section 22, and the identification information on each core body 50 is read by the identification section 22.

Figure 4:
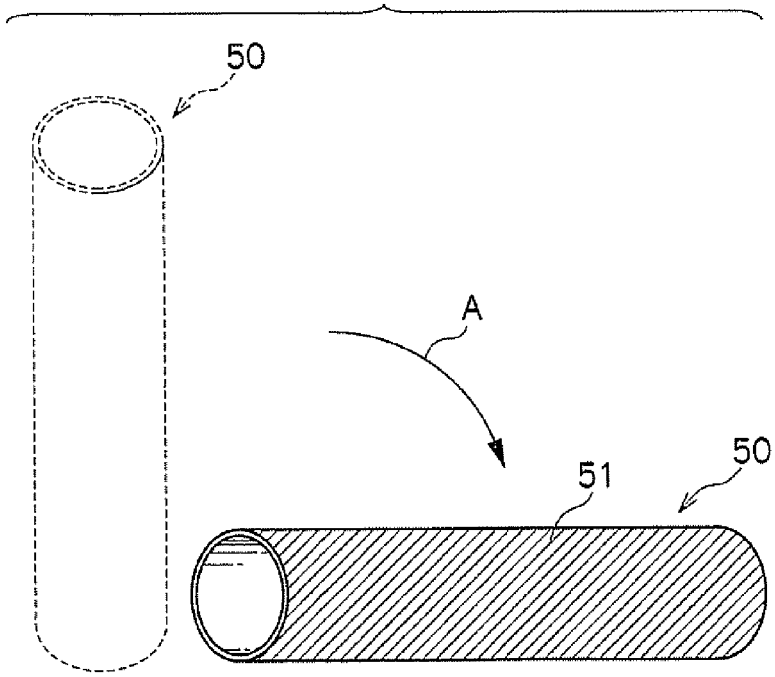
FIG. 4 is a schematic drawing showing a state where a core body is horizontally toppled when the core body placed on the seat is transferred to a film-forming step.

The film-forming section 24 is a device for forming the coating film 52A on the outer peripheral surface of the core body 50 by applying the resin solution 52B to the outer peripheral surface of the core body 50, on which the releasing layer 51 is formed. When the identification information of the core body 50 mounted on the seat 40 is read by the identification section 22, the core body 50, whose identification information has been read, is conveyed to the film-forming section 24 by a drive mechanism (that is not shown in the drawing). For example, as shown in FIG. 4, each core body 50 mounted on the seat 40 is toppled so that the axial direction of the core body 50 becomes horizontal (pushed down in the direction of Arrow A in FIG. 4), and the core body 50 is conveyed to the film-forming section 24 by a drive mechanism (that is not shown in the drawing).

Figure 5:
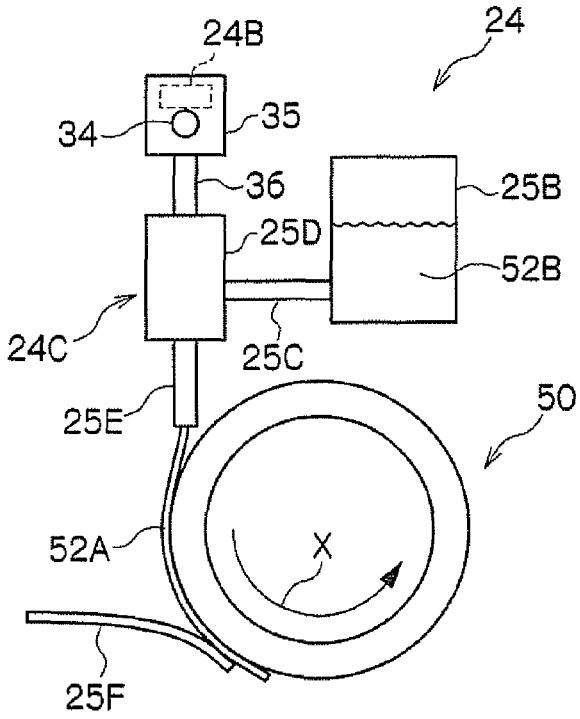
FIG. 5 is a schematic drawing showing the structure of a film-forming section, and a cross-sectional view of the schematic drawing as shown in FIG. 6.
Figure 6:
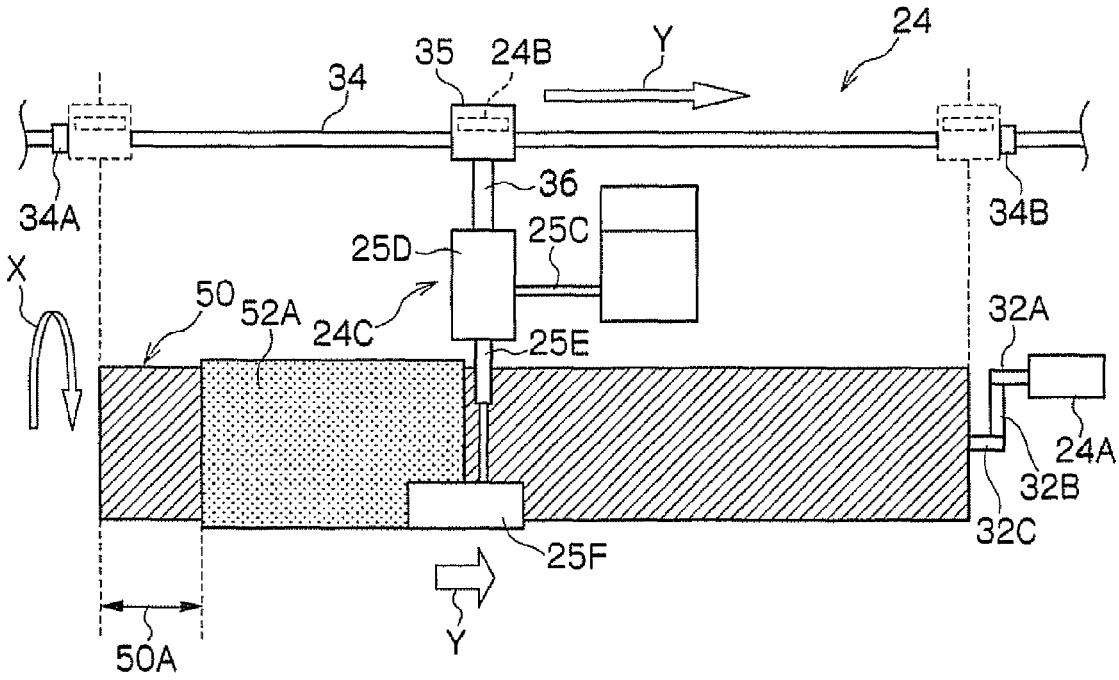
FIG. 6 is a schematic drawing showing the structure of the film-forming section.

As shown in FIGS. 1, 5 and 6, the film-forming section 24 is constituted by including a supply unit 24C, a rotation drive unit 24A which drives rotationally the core body 50 in the circumferential direction, and a motor 24B which moves the supply unit 24C in the axial direction of the core body 50. The rotation drive unit 24A, the motor 24B and the supply unit 24C are connected to the control section 30, respectively, to enable transmission and reception of signals.

As shown in FIGS. 5 and 6, the supply unit 24C is a device which supplies a resin solution 52B to the outer peripheral surface of the core body 50. The resin solution 52B stored in a storage unit 25B passes through a supply pipe 25C, is extruded from an ejection unit 25D and then passes through a nozzle 2SE, and is thereby supplied to the outer peripheral surface of the core body 50. As the supply unit 24C, a dispenser may be exemplified.

The resin solution 52B is a solution containing a material which constitutes the cylindrical member 52 to be formed. Examples of the resin solution 52B include a polyimide varnish, a polyimide precursor varnish and an inorganic filler-containing varnish formed by containing inorganic filler into the polyimide varnish or the polyimide precursor varnish. When these varnishes are used as a resin solution 52B, the cylindrical member 52 formed from the polyimide resin can be manufactured.

In the exemplary embodiment, although the following explanations will be made in the case where the polyimide resin as the resin solution 52B is used, any solutions of constituent materials for forming the cylindrical member 52 may be used. As the constituent material for forming the cylindrical member 52, a thermosetting resin is desirable, and specifically, the polyimide-based resin, a polyamideimide-based resin, a polyester-based resin, a polyamide-based resin, a fluorine-based resin, and the like may be exemplified. In particular, when the cylindrical member 52 used for an intermediate transfer belt and a transfer convey belt in the image forming apparatus used for the electrophotographic system are manufactured, the polyimide-based resin containing an electroconductive agent (inorganic filler) may be suitably used.

As shown in FIGS. 5 and 6, the core body 50 is rotatably supported at the axial center thereof in the film-forming section 24 by bearings (that are not shown in the drawing). An elongated rail 34 is arranged such that a space is provided between the rail 34 and the core body 50, and the rail 34 is extended in the axial direction of the core body 50 in the vicinity of the core body 50 in a state of being supported in the film-forming section 24.

The supply unit 24C is supported by a linear guide 35 movably supported in the longitudinal direction of the rail 34 through a holder 36. The motor 24B is installed on the linear guide 35. The motor 24B is connected to the control section 30 to enable transmission and reception of signals. The motor 24B is driven in accordance with control signals from the control section 30, and the supply unit 24C is moved by the drive of the motor 24B from one end toward the other end in the axial direction of the core body 50.

In the exemplary embodiment, a start positioning component 34A for positioning the starting position is arranged at one end part of the longitudinal direction of the rail 34, and the end positioning component 34B for positioning the ending position is arranged at the other end part. In the exemplary embodiment the starting positioning component 34A is placed such that the position of a nozzle 25E of the supply unit 24C is arranged at the position corresponding to the edge of one end in the axial direction of the core body 50, when the linear guide 35 reaches the start positioning component 34A. Further, when the linear guide 35 arrives at the mounting position of the end positioning component 34B, the end positioning component 34B is placed such that the nozzle 25E of the supply unit 24C is arranged at the position corresponding to the edge of other end in the axial direction of the core body 50.

Accordingly, the supply unit 24C is moved from the position corresponding to the edge of one end in the axial direction of the core body 50 to the position corresponding to the edge of other end in the axial direction of the core body 50 with the movement of the linear guide 35 from the start positioning component 34A to the position where the end positioning component 34B is mounted.

The rotation drive unit 24A installed in the film-forming section 24 transmits a drive force to the rotating shaft of the core body 50 through a gear 32A, gear 32B, and gear 32C. Accordingly, the core body 50 rotates in the circumferential direction (direction of Arrow X in FIGS. 5 and 6) by being driven by the rotation drive unit 24A with the control by the control section 30.

In the film-forming section 24 constituted in such a way, while the core body 50 is being rotated by the drive of the rotation drive unit 24A in the circumferential direction of the core body 50, the resin solution 52B is supplied toward the outer peripheral surface of the core body 50 from the supply unit 24C, and the supply unit 24C is moved in the axial direction of the core body 50 (direction of Arrow Y in FIG. 6) by the motor 24B and the surface of the supplied resin solution is smoothed with a blade 25F which moves together with the supply unit 24C. In this way, the resin solution 52B is supplied to the outer peripheral surface of the core body 50, thereby forming the coating film 52A on the outer peripheral surface of the core body 50.

In addition, in the film-forming section 24, the resin solution 52B is not applied to the entire region from one end portion to the other end portion in the axial direction of the outer peripheral surface of the core body 50, but rather, the resin solution 52B is applied to the region at the central portion from both ends in the axial direction of the core body 50, to form the coating film 52A.

Figure 7:
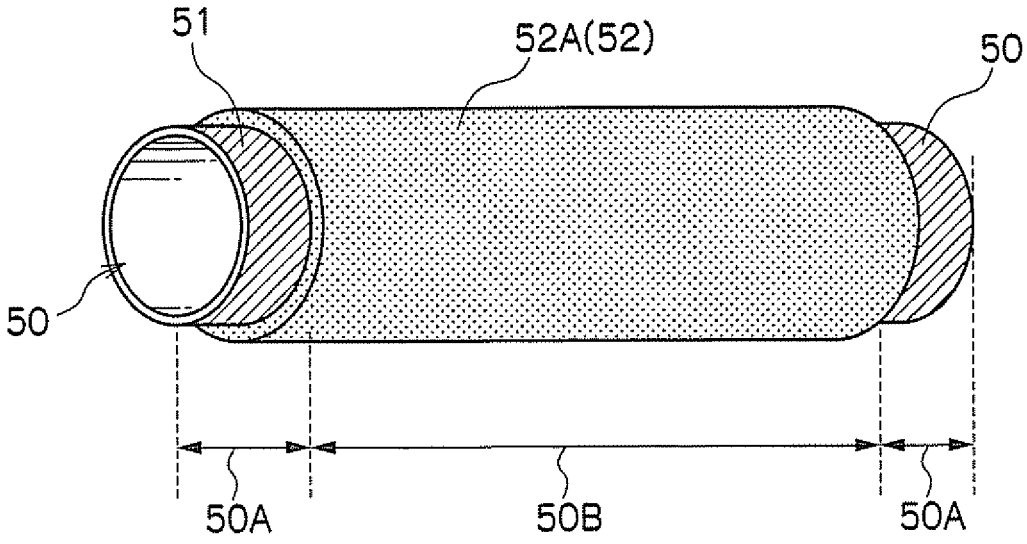
FIG. 7 is a schematic drawing showing a state where a coating film is formed on the core body.

Specifically, as shown in FIG. 7, the central region 50B at the inner side from both end regions 50A in the axial direction within the entire outer peripheral surface of the core body 50 is the region 50B where the resin solution 52B is coated (hereinafter, referred to as a "film-forming region"), and the coating film 52A is formed on the film-forming region 50B. Accordingly, in the formation of the coating film 52A on the core body 50, regions where the coating film 52A is not formed exist at both ends in the axial direction of the surface of the core body 50. Here, both ends mean portions including the ends of the core body 50, and the central portion means the center in the axial direction of the core body (the position at one half of the length of the core body from the end of the core body).

This is because the regions where the coating film 52A is not formed at both ends in the axial direction of the core body 50 are required, since there is a concern that the supplied resin solution 52B may drip from the end edges of the core body 50 if the resin solution 52B is supplied to the entire outer peripheral surface of the core body 50 at the time when the coating film 52A is formed, and further, since the formed coating film 52A is released from the core body 50 by introducing air from both ends of the coating film 52A when the coating film 52A is released from the core body 50 after the formed coating film 52A is dried and baked in a subsequent process step.

In the film-forming section 24, for the purpose of preventing liquid-dripping of the coating film 59A, the coating film 52A is dried by evaporating the solvent to such an extent that liquid-dripping from the coating film 52A does not arise, while the core body 50 having the coating film 52A formed thereon is being rotated in the circumferential direction by being driven by the rotation drive unit 24A. Incidentally, the drying process may be carried out in the baking section 26. In this case, a mechanism may be installed, in which the core body 50 is rotated in the circumferential direction while the core body 50 is being held in the horizontal direction in the baking section 26.

Figure 8:
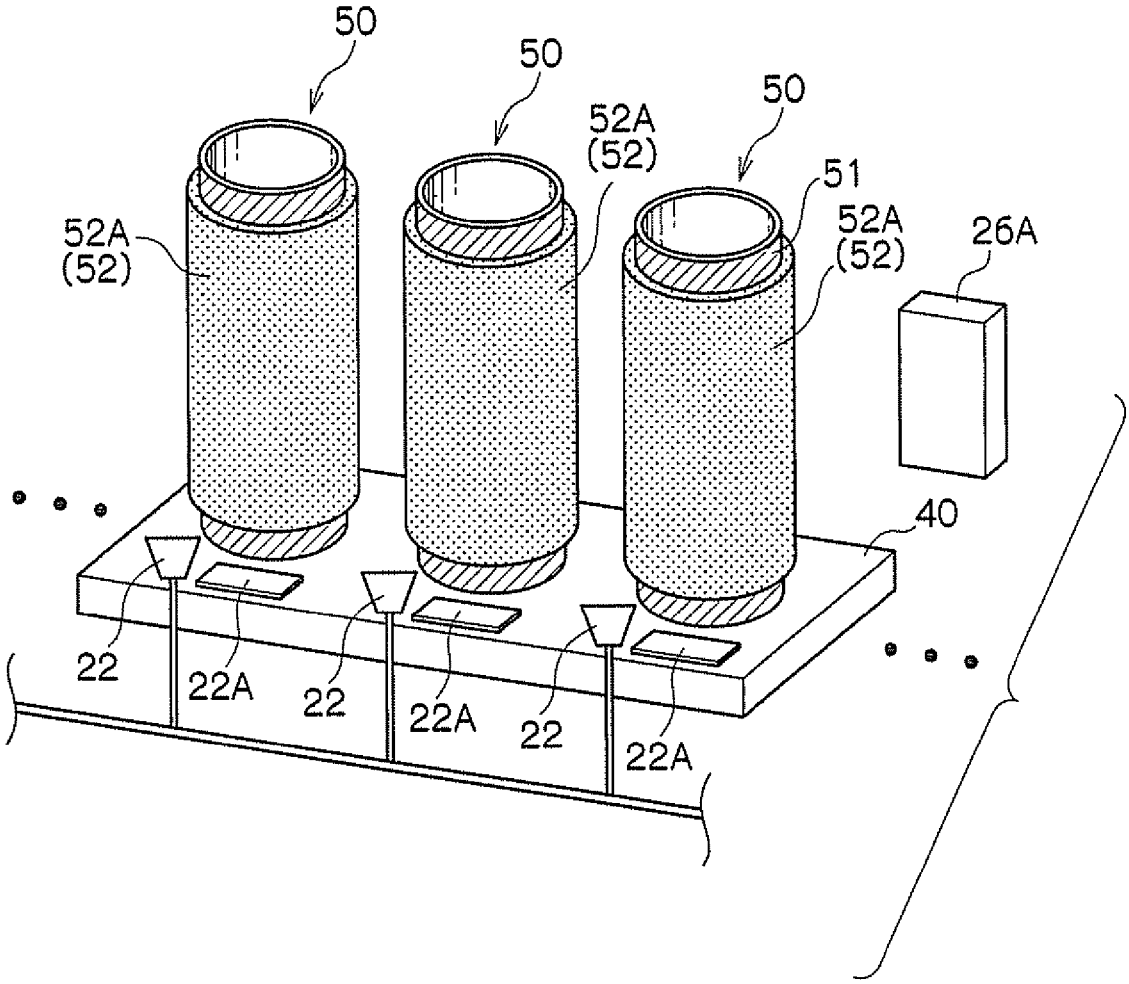
FIG. 8 is a schematic drawing showing the structure of a baking section.

In the film-forming section 24, the core body 50, in a state where the coating film 52A is formed on the central regions from both ends on the outer peripheral surface in the axial direction, and is dried to such an extent that liquid-dripping does not arise, is secured onto the seat 40 in the upright state again by being conveyed by a conveying mechanism (that is not shown in the drawing) (refer to FIG. 8). At this time, each core body 50 is conveyed by the conveyance mechanism (that is not shown in the drawing) such that the core body 50 is mounted to the position corresponding to the identification plate 22A, on which the identification information of each core body 50 is recorded.

In the baking section 26, the core body 50 formed the coating film 52A thereon, in such a state that the coating film 52A does not cause liquid-dripping, is secured onto the seat 40, and is maintained in the environment of a predetermined baking temperature, thereby baking the coating film 52A. The baking condition of the coating film 52A in the baking section 26 is controlled by a baking condition controlling section (hereinafter, referred to as a baking condition control unit) 26A. The baking condition control unit 26A is connected to the control section 30 to enable transmission and reception of signals, and the baking environment is conditioned by the baking condition control unit 26A by way of the control section 30 in accordance with the materials and the like of the coating film 52A.

Figure 9:
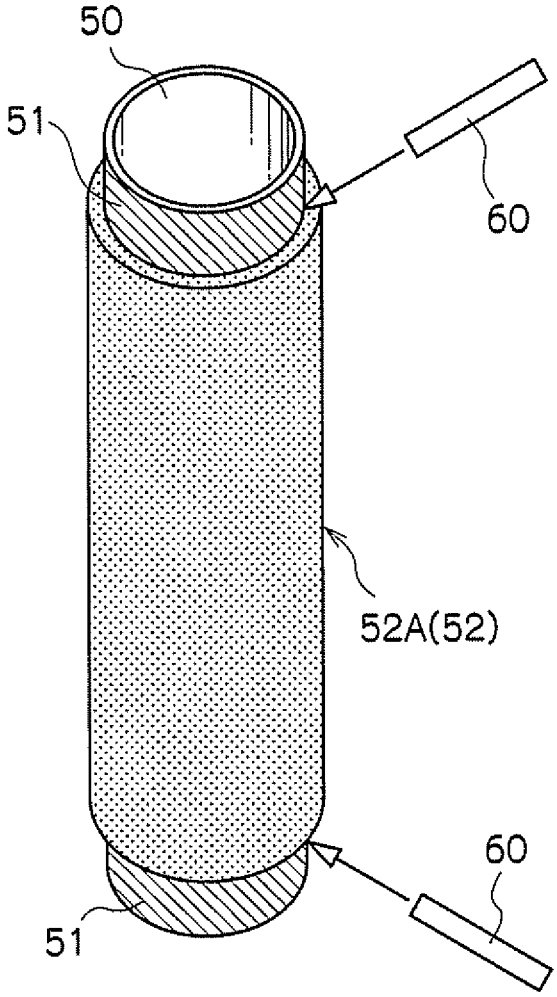
FIG. 9 is a schematic drawing showing the step of removing the baked coating film.

The baked coating film 52A is removed from the core body 50 having the coating film 52A baked by being maintained in the environment of being heated and baked in the baking section 26, in the releasing section 28, thereby forming the cylindrical member 52. As shown in FIG. 9, air injection members 60 which blow air at high pressure are arranged in the releasing section 28, and the air is injected between both ends of the baked coating film 52A and the outer peripheral surface of the core body 50, so that the baked coating film 52A is released from the core body 50.

In the cylindrical member manufacturing apparatus 10, the series of processes including the film formation of the coating film 52A by coating the resin solution 52B in the film-forming section 24, the heating and baking in the baking section 26, and the release of the baked coating film 52A from the core body 50 in the releasing section 28 is performed as described in the above, so that the cylindrical body 52 is manufactured. The series of the processes are repeatedly performed, and the cylindrical bodies 52 are successively manufactured.

Here, as described above, the releasing layer 51 has been formed in the outer peripheral surface of the core body 50, to impart the releasing property to the outer peripheral surface of the core body 50. In the coating film 52A which is baked after the coating film 52A is formed on the outer peripheral surface of the core body 50 having an outer peripheral surface with a releasing property, air is injected between both ends of the baked coating film 52A and the outer peripheral surface of the core body 50, so that the baked coating film 52A is easily released from the core body 50.

However, in the manufacturing process of the cylindrical member 52 as described above, the coating film 52A is formed in the region at the central portion in the axial direction from both ends of the core body 50, from the viewpoint of controlling the releasing property of the cylindrical member 52 and preventing the resin solution 52B from dripping from the ends of the core body 50. In the baking section 26, the core body 50 is also maintained in the baking environment in order to bake the coating film 52A. Accordingly, the regions of the core body 50 (regions 50A in FIG. 7), where the coating film 52A is not formed, are also exposed to an atmosphere at a high temperature together with the coating film 52A, and the releasing property of the exposed region 50A is more easily deteriorated than that of the region (film-forming region 50B) covered with the coating film 52A. Therefore, even if air is injected between both ends in the axial direction of the baked coating film 52A and the outer peripheral surface of the core body 50, there may be cases where the releasing of the baked coating film 52A from the core body 50 becomes difficult due to sticking of the coating film 52A to the outer peripheral surface of the core body 50, in the case where the releasing property in the regions continuous from the coating film 52A is deteriorated.

In addition, in order to recover the releasing property of the outer peripheral surface of the core body 50, it is considered that a method may be used, in which the releasing property is recovered by repeatedly applying a releasing agent to the core body 50 and baking the releasing agent-coated core body 50 for each predetermined period, but this method requires a great many man-hours for the recovery of the releasing property. Moreover, in order to compensate for the shortage of the core bodies 50 in the cylindrical member manufacturing apparatus 10 in such a recovery process of the releasing property, it is required that extra core bodies 50 be prepared.

Accordingly, in the cylindrical member manufacturing apparatus 10 according to the exemplary embodiment, when the deterioration of the releasing property in the regions continuous from the region where the coating film 52A is to be formed, at both ends in the axial direction of the outer peripheral surface of the core body 50 is judged in the control section 30, the film-forming section 24 is controlled such that the coating film 52A is formed so that regions with an undeteriorated releasing property are exposed on both end portions in the axial direction on the outer peripheral surface of the core body 50. According to this control, the coating film 52A is formed on the outer peripheral surface of the core body 50 in the state where regions with an undeteriorated releasing property on both end portions in the axial direction of the core body 50 are always exposed, so that easy releasing of the baked coating film 52A from the core body 50 can be maintained over a long period of time.

Hereinafter, the control executed in the control section 30 will be described in detail.

The control section 30 controls each unit of the cylindrical member manufacturing apparatus 10. As described above, the control section 30 is connected to the identification section 22, the rotation drive unit 24A, the motor 24B, the baking condition control unit 26A and the releasing section 28 to enable transmission and reception of signals. The control section 30 is constituted by connecting a CPU (central processing unit) 30A to a memory 30B via a bus.

The memory 30B stores beforehand the process routine (refer to FIG. 10), which will be described later, a deterioration judgment table, an information table on the number of times of cylindrical member manufacturing, the starting position information indicating the starting position for coating the resin solution 52B, the ending position information indicating the ending position for coating the resin solution 52B, and various data, and further, stores various data additionally.

The deterioration judgment table is a table which specifies the criteria of the judgment of the deterioration of the outer peripheral surface of the core body 50, and is a table in which information relating to the number of times of cylindrical member manufacturing indicating the number of times cylindrical members have been manufactured on the core body 50 is correlated beforehand to information indicating the deterioration or information indicating the undeterioration. The number of times cylindrical members have been manufactured on the core body 50 are counted in such a manner that in the cylindrical member manufacturing apparatus 10, one series of processes (hereinafter, referred to as a cylindrical member manufacture process) including the film-forming process of the coating film 52A by coating the resin solution 52B on the core body 50 in the film-forming section 24, the drying process, the heating and baking in the baking section 26, and the removal of the cylindrical member 52 from the core body 50 in the releasing section 28, is counted as one time.

The deterioration information is information which indicates that the regions continuous from the region where the coating film 52A is to be formed, at both ends in the axial direction of the outer peripheral surface of the core body 50 are in the state of a deteriorated releasing property. The undeterioration information is information which indicates that the regions continuous from the region where the coating film 52A is to be formed, at both ends in the axial direction of the outer peripheral surface of the core body 50 are not in the state of a deteriorated releasing property.

The deterioration information and the undeterioration information are information which is judged as to whether the regions where the coating film 52A is not formed on the outer peripheral surface of the core body 50, on which the releasing layer 51 has been formed, are deteriorated, in accordance with the number of times of performing manufacturing processing of the cylindrical member (number of times of cylindrical member manufacturing), and the information can be stored in the deterioration judgment table, in which the judgment results are correlated to the information regarding the number of times of cylindrical member manufacturing beforehand.

The judgment as to whether the outer peripheral surface of the core body is deteriorated or is not deteriorated, for example, may be performed in the following manner. The contact angle of water on the regions where the coating film 52A is not formed on the outer peripheral surface of the core body 50, on which the releasing layer 51 has been formed, is measured each time the cylindrical member manufacturing process is performed. When the contact angle of water is 10° or less under the conditions of 25° C. and 50% RH, the releasing property is judged to be in the state of "deterioration", and when the contact angle exceeds 10°, the releasing property is judged to be in the state of "undeterioration", and the judgment results are stored in correlation with the processing times information.

In addition, the contact angle of water is obtained in such a manner that after about 31 μl of pure water is dropped onto the surface of the region to be measured of the outer peripheral surface of the core body 50 in the environment of 25° and 50% RH, with the use of an automatic contact meter DM500 (trade name) manufactured by Kyowa Interface Science Co., Ltd., and the coordinate of one end, the other end and the vertical angle of the water drop at 15 seconds after dropping is image-processed, and the contact angle W of water is obtained based on the calculated diameter (2r) and the height (h) of the water drop from the following equation (in the equation, "r" represents the radius of the water drop);

$$W=2\tan^{-1}(h/r).$$

For example, as a deterioration judgment table, the table shown in Table 1 is beforehand stored in the memory 30B.

TABLE 1

| Number of Times of Manufacture of Cylindrical Member | Deterioration/ Undeterioration |
|---|---|
| 0 to 49 | Undeteriorated |
| 50 or more | Deteriorated |

In the exemplary embodiment, it is judged that when the contact angle of water is 10° or less, the releasing property is in a deteriorated state, and when the contact angle of water exceeds 10°, the releasing property is not in a deteriorated state. However, this judgment criteria are based on the contact angle in the case where a polyimide resin coating film is used as the coating film 52A, and a material formed from a silicone-based releasing agent or a fluorine-based releasing agent is used as the releasing layer 51 with a thickness of 0.05 μm (the thickness when the cylindrical member manufacturing process has not yet been carried out) on the core body 50. Accordingly the angle for the judgment criteria of the deterioration of the releasing property may be changed in accordance with the constituent material of the coating film 52A or the constituent material of the releasing layer 51, and is not limited to the angle of 10°.

Figure 10:
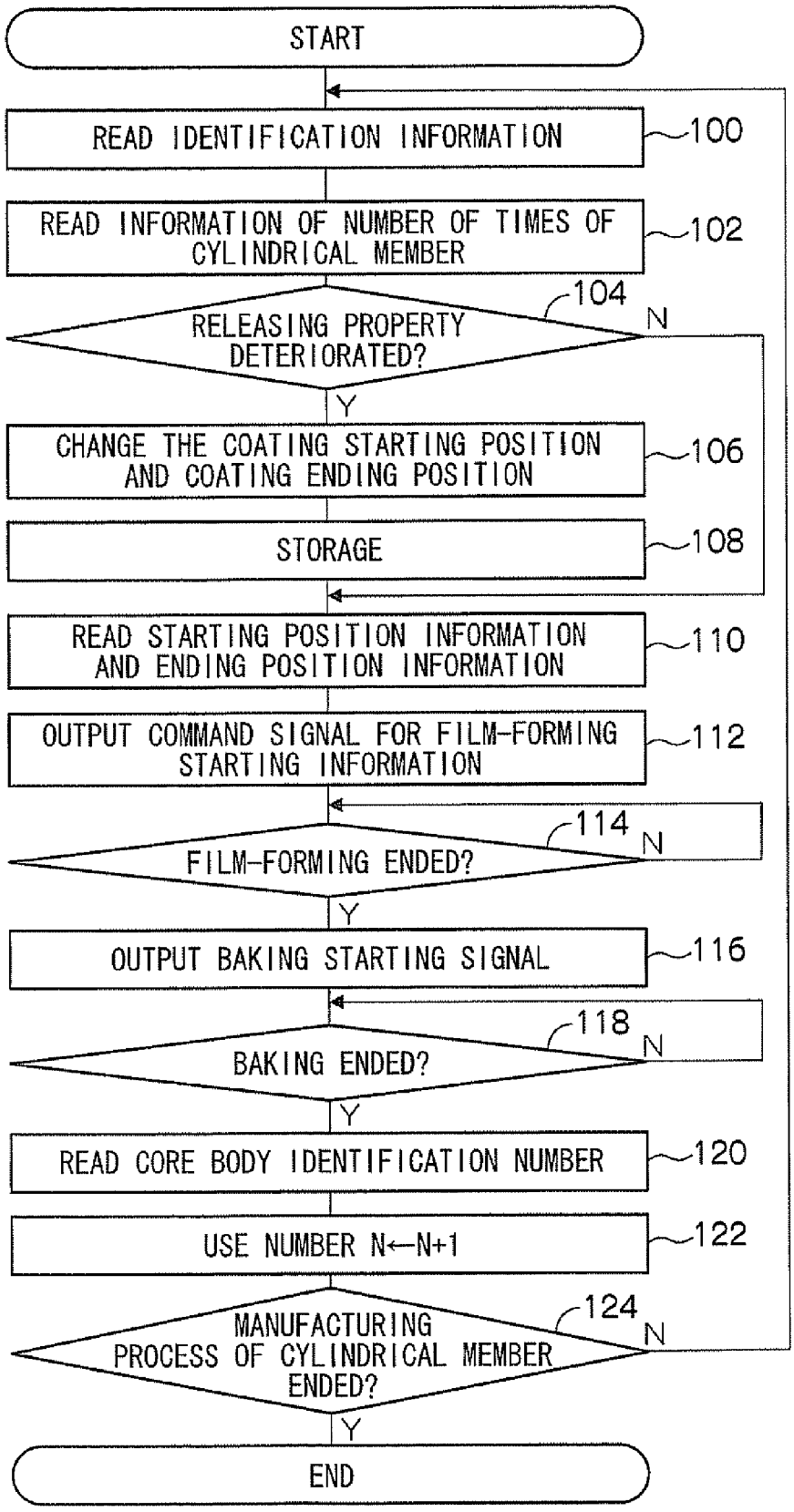
FIG. 10 is a flow chart showing processes executed by a CPU in the apparatus for manufacturing a cylindrical member.

When the judgment criteria is changed in accordance with the constituent material of the coating film 52A or the constituent material of the releasing layer 51, the deterioration judgment table may be obtained beforehand and stored in the memory 30 for each constituent material of the coating film 52A or constituent material of the releasing layer 51, and information for prompting an operator to input information indicating the material for forming the releasing layer 52 formed on the outer peripheral surface of the core body 50 used the material for forming the cylindrical member 52, and the constituent material of the coating film 52A is displayed on the output unit 23 to prompt the operator to input the information, prior to the execution of the process routine as shown in FIG. 10. When the information is inputted from the input unit 21, the deterioration judgment table corresponding to the information is read, and the read table is used in the process routine as shown in FIG. 10.

The information table of the number of times of the cylindrical member manufacturing is a table in which the identification information for identifying the core body 50 in correlation with the information of the number of times of the manufacture of the cylindrical member indicating the number of times of the cylindrical member manufacturing is stored. The information of the number of times of the manufacture of the cylindrical member is counted up by the CPU 30A, each time the series of the cylindrical member manufacturing processes for manufacturing the core body 50 corresponding to the information is performed When the core body 50 identified by the information corresponding to the information of the number of times of the cylindrical member manufacturing stored in the information table of the number of times of the cylindrical member manufacturing, is subjected to the releasing property recovery process for restoring the releasing property over the entire region of the outer peripheral surface, the number of times of the cylindrical member manufacturing may reset to "0". For example, the reset of the number of times of the cylindrical member manufacturing may be made to "0" by inputting information by a user, or alternatively, a releasing property recovery mechanism may be installed in the cylindrical member manufacturing apparatus 10, separately, and a process, in which the number of times of the cylindrical member manufacturing corresponding to the identification number of the core body 50 which has been subjected to the releasing property recovery process, is rewritten to "0", may be executed in the CPU 30A.

Examples of the releasing property recovery processes include a process in which a releasing agent is again applied to the outer peripheral surface of the core body 50 to form a releasing layer 51, and the releasing agent-coated core body 50 is baked.

The starting position information which indicates the starting position for coating the resin solution 52B is information for indicating the starting position for coating the resin solution 52B onto the core body 50. The ending position information which indicates the ending position for coating the resin solution 52B is information for indicating the ending position for coating of the resin solution 52B onto the core body 50. These starting position information and ending position information are stored beforehand in correlation with the identification information for identifying the core body 50 in the memory 30B.

Figure 11A:
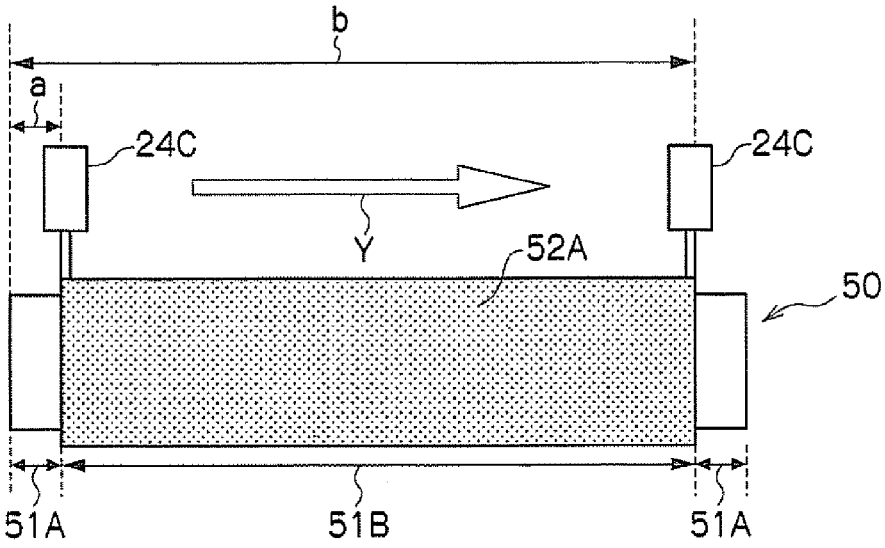
FIG. 11A is a schematic drawing showing a state where a coating film to be formed on a core body is shifted to the central portion in the axial direction of the core body by executing the process routine as shown in FIG. 10.

For example, as shown in FIG. 11A, the information which indicates the position of the distance "a" from an end in the axial direction of the core body 50 is stored beforehand as the coating starting position, and the information which indicates the position of the distance "b" from the end of the axial direction is beforehand stored as the coating ending position.

As described above, the distance "a" and the distance "b" may be determined such that the positions are in the central side positions in the axial direction from both ends of the axial direction of the core body 50, so that at least regions, where the coating film 52A is not coated, are formed at both end portions in the axial direction of the core body 50. The regions may be determined in accordance with the width (length in the axial direction) of the cylindrical member 52 to be formed, or the length of the core body 50 in the axial direction.

In addition, the values of the distance "a" and the distance "b" are to be overwritten in the process routine, which will be described later.

In the CPU 30A of the control section 30, when a command signal for starting the cylindrical member manufacturing process is inputted by the operation of a command button (that is not shown in drawing) by a user after the core body 50 is mounted to the seat 40, the process routine as shown in FIG. 10 is executed to proceed to step 100.

In the step 100, the identification information of the core body 50 to be subjected to the film-forming process is read. In the step 100, the signal indicating the identification information of the core body 50 inputted from the identification section 22, is read, thereby reading the identification information of the core body 50 to be subjected to the film-forming process.

In the next step 102, the information of the number of times of the cylindrical member manufacturing corresponding to the identification information which has been read in the step 100 is read from the information table of the number of times of the cylindrical member manufacturing stored in the memory 30B.

In the next step 104, it is judged whether the releasing property in the regions continuous from the film-forming region of the coating film 52A to be formed at the inner side from both ends on the outer peripheral surface in the axial direction of the core body 50 corresponding to the identification information which has been read in the step 100 is deteriorated, or is not deteriorated. The judgment in the step 104 is executed to judge as to whether the information which indicates deterioration or undeterioration corresponding to information of the number of times of the cylindrical member manufacturing in the deterioration judgment table stored in the memory 20B which has been read in the step 102 is deterioration information.

For example, when the deterioration judgment table as shown in Table 1 as a deterioration judgment table is specified, it is judged that the releasing property is deteriorated when the information of the number of times of the cylindrical member manufacturing read in the step 102 is information indicating 50 times, and it is judged that the releasing property is not deteriorated when the information of the number of times of the cylindrical member manufacturing is information indicating 49 times or less.

When the judgment in the step 104 is negative, namely, when the releasing property in the regions continuous from the film-forming region of the coating film 52A to be formed at the inner side from both ends on the outer peripheral surface in the axial direction of the core body 50 to be processed is undeteriorated, the flow proceeds to step 110, which will be described later.

On the other hand, if the judgment in the step 104 is affirmative, namely, when the releasing property in the regions continuous from the film-forming region of the coating film 52A to be formed at the inner side from both ends on the outer peripheral surface in the axial direction of the core body 50 to be processed is deteriorated, the flow proceeds to step 106.

In the step 106, the coating starting position and the coating ending position of the resin solution 52B on the core body 50 are changed to the central portion from the previous coating starting position and the previous coating ending position in the axial direction, respectively.

Specifically, in the step 106, the starting position information and ending position information corresponding to the identification information which has been read in the step 100 are read, and the coating starting position and the coating ending position which are indicated by the read starting position information and the read ending position information are changed such that the positions are shifted to the central portion in the axial direction of the core body 50 from the previous respective positions.

For example, when the starting position information corresponding to the identification information stored in the memory 30B which has been read in the step 100 indicates the position of the distance "a" from the end of the core body 50 in the axial direction as shown in FIG. 11A, the starting position information is changed such that the coating starting position is "a1" which includes a distance a' that is shifted from the distance "a" to the central portion in the axial direction of the core body 50. Similarly, as shown in FIG. 11A, when the ending position information corresponding to the identification information stored in the memory 30B which has been read in the step 100 indicates the position of the distance "b" from the end of the core body 50 in the axial direction as shown in FIG. 11A, the ending position information is changed such that the coating starting position is "b1" that is shifted by the distance b' from the distance "b" to the central portion in the axial direction of the core body 50.

In addition, the adjustment distances a' and b' may be any distances having regions with the releasing property required for releasing easily the baked coating film 52A from the core body 50, and may be determined beforehand in accordance with the material of the releasing layer 51, or the material of the coating film 52A.

In the next step 108, the starting position information indicating the coating starting position changed in the step 106, and the ending position information indicating the coating ending position changed in the step 106 are overwritten and stored in the memory 30B in correlation with the identification information which has been read in the step 100, so that the starting position information and ending position information corresponding to the identification information stored in the memory 30B are rewritten, respectively.

In the processes from the step 104 to the step 108, when it is judged that the releasing property in the regions continuous from the film-forming region of the coating film 52A at the inner side from both ends on the outer peripheral surface in the axial direction of the core body 50 is not deteriorated, the supply starting position and supply ending position of the resin solution 52B are not changed and are identical to the previous supply starting position and supply ending position of the resin solution 52B, respectively.

On the other hand, when it is judged that the releasing property in the regions continuous from the film-forming region of the coating film 52A at the inner side from both ends on the outer peripheral surface in the axial direction of the core body 50 is deteriorated, the supply starting position and supply ending position of the resin solution 52B are changed such that the supply starting position and supply ending position of the resin solution 52B are shifted to the central portion from the previous supply starting position and the previous supply ending position of the resin solution 52B in the axial direction, respectively.

In the next step 110, the starting position information and the ending position information indicating the coating starting position and the coating ending position, respectively, corresponding to the identification information which has been read in the step 100, are read from the memory 30B.

In the next step 112, the film-forming starting information command signals including the identification information, the starting position information, the ending position information and the command signal indicating the starting of the film-formation, which have been read in the step 110, are outputted to the film-forming section 24.

In the film-forming section 24 which received the film-forming starting information command signals, while the core body 50 is being rotated by the drive of the rotation drive unit 24A in the circumferential direction of the core body 50, the resin solution 52B is supplied to the outer peripheral surface of the core body 50 from the supply unit 24C, and the supply unit 24C is moved in the axial direction of the core body 50 (direction of Arrow Y in FIG. 6) by the motor 24B and the surface of the supplied resin solution is smoothed with the blade 25F which moves together with the supply unit 24C.

In more detail, the motor 24B which receives the starting position information and the ending position information contained in the film-forming starting command signals moves the supply unit 24C in the axial direction of the core body 50 from the film-forming starting position in the starting position information to the film-forming ending position in the ending position information contained in the received film-forming command signals. Further, the rotation drive unit 24A which receives the film-forming start command signal initiates the rotation of the core body 50 in the circumferential direction.

The CPU 30A receives the signal indicating that the supply unit 24C reaches the film-forming starting position by the drive of the motor 24B, and upon receipt of the signal, the CPU 30A outputs the signal indicating the supply starting to the supply unit 24C. Upon receipt of the signal indicating the supply start, the supply unit 24C starts the supply of the resin solution 52B by opening a valve (that is not shown in the drawing). Further, the CPU 30A receives the signal indicating that the supply unit 24C moves and arrives at the film-forming ending position from the film-forming start position by the drive of the motor 24B, and upon receipt of the signal, the CPU 30A outputs the signal indicating the supply ending to the supply unit 24C. The supply unit 24C which receives the supply ending signal indicating closes the valve (that is not shown in the drawing) to stop the supply of the resin solution 52B.

That is, in the process of the step 112, the resin solution 52B is applied to the outer peripheral surface of the core body 50 from the coating starting position to the coating ending position which have been read in the step 110, thereby forming the coating film 52A.

In the processes from the step 104 to the step 108, when the releasing property in the regions continuous from the film-forming region of the coating film 52A to be formed at the inner side from both ends on the outer peripheral surface in the axial direction of the core body 50 is not deteriorated, the supply starting position and supply ending position of the resin solution 52B are not changed and are identical to the previous supply starting position and supply ending position of the resin solution 52B, and when the releasing property is deteriorated, the supply starting position and supply ending position of the resin solution 52B are changed to the central portion from the previous supply starting position and the previous supply ending position of the resin solution 52B in the axial direction, respectively.

Accordingly, in the process of the step 112, the coating film 52A is formed such that the regions, where the releasing property is not deteriorated, are always exposed in the regions continuous from the coating film 52A at the inner side from both ends on the outer peripheral surface in the axial direction of the core body 50.

In the next step 114, the negative judgment is repeatedly checked until the film-forming process of the coating film 52A in the step 112 is completed, and if the judgment is affirmative, the routine proceeds to step 116. In the judgment in the step 114, for example, the signal indicating that the supply unit 24C is moved and arrives at the film-forming ending position from the film-forming starting position by the drive of the motor 24B is received, and upon receipt of the signal, the signal indicating the supply ending is outputted to the supply unit 24C, and the affirmative judgment can be made.

In the film-forming section 24, the coating film 52A is formed in the region of the central portion from both ends of the axial direction on the outer peripheral surface, and the core body 50 which has been subjected to the drying process as described in the above is in the state where liquid-dripping is not caused, is mounted again onto the seat 40 (refer to FIG. 8) by a conveyance mechanism (that is not shown in the drawing). At this time, each core body 50 is conveyed by the conveyance mechanism (that is not shown in the drawing) such that the core body 50 is mounted to the position corresponding to the identification plate 22A, on which the identification information for each core body 50 is recorded.

In the next step 116, baking start signals including the condition signal indicating the baking conditions of the coating film 52A and the baking start signal indicating the start of drying and baking are outputted to the baking section 26.

The baking condition control unit 26A in the baking section 26, which has received the baking starting signals, controls the baking conditions for conditioning the baking in accordance with the condition signal contained in the baking starting signals, and the baking of the coating film 52A is performed.

In the next step 118, the negative judgment is repeatedly checked until the baking of the coating film 52A is completed, and if the judgment is affirmative, the routine proceeds to step 120. In the judgment in the step 118, ending signal indicating the completion of the baking is received, and upon receipt of the ending signal, the affirmative judgment can be made.

In the releasing section 28, the baked coating film 52A formed by being maintained in the baking environment in the baking section 26, is removed from the core body 50 by injecting air between the core body 50 and the coating film 52A from both ends of the coating film 52A, thereby forming a cylindrical body 52.

In the next step 120, the identification information of the core body 50 which has been subjected to the series of the processes is read by the identification section 22. In the step 120, the signal indicating a reading command is outputted to each identification section 22 prepared at the position corresponding to the identification plate 22A installed at the position corresponding to each core body 50 on the seat 40, and the identification information of the core body 50 is read by receiving the identification information received from each identification section 22.

In the next step 122, the number of times of the cylindrical member manufacturing corresponding to the identification information which is read from the information table of the number of times of the cylindrical member manufacturing stored in the memory 30B is incremented by one.

In the next step 124, it is judged as to whether the manufacture process of the cylindrical member is finished, and if the judgment is negative, the flow returns to the step 100, and if the judgment is affirmative, the process routine ends. For example, in the step 124, the affirmative judgment may be made when the signal indicating the end of process is inputted from the input unit 21, or alternatively, the number of times of the manufacture processes of the cylindrical member to be successively manufactured is stored beforehand in the memory 30B, and the number of times of the manufacture processes is incremented one by one, each time the process from step 100 to step 122 is executed, and the affirmative judgment may be made when the number of times of the manufacture processes thus counted up becomes coincident with the number stored beforehand.

Figure 11B:
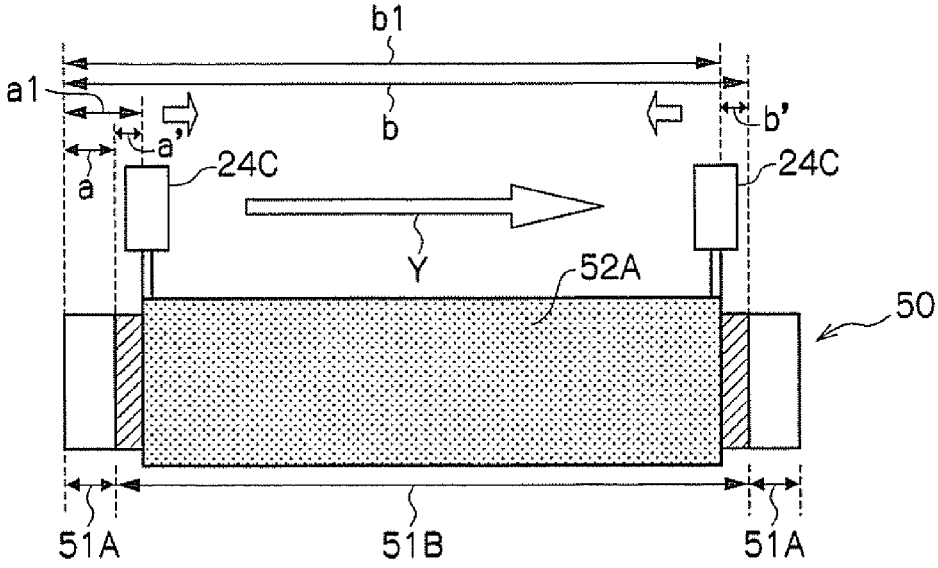
FIG. 11B is a schematic drawing showing a state where the coating film to be formed on the core body is shifted to the central portion in the axial direction of the core body by executing the process routine as shown in FIG. 10.

By executing the process routine from the step 100 to the step 124, as shown in FIG. 11A, when the releasing property in the regions continuous from the film-forming region where the coating film 52A is to be formed, at both end portions in the axial direction of the outer peripheral surface of the core body 50, is not deteriorated, the coating film 52A is formed in the predetermined position at the central portion from both ends in the axial direction. When the series of the processes are repeatedly performed, and the releasing property in the regions continuous from the region where the coating film 52A is to be formed is deteriorated thereby (refer to the region 51A in FIGS. 11A and 11B), the coating starting position and the coating ending position of the coating film 52A are changed toward the central portion in the axial direction, respectively, such that the regions where the releasing property is not deteriorated (region 51B in FIGS. 11A and 11B) are exposed in the regions continuous from both ends in the axial direction of the coating film 52A. For this reason, as shown in FIG. 11B, the coating film 52A is formed on the outer peripheral surface of the core body 50 such that the undeteriorated regions (undeteriorated region 51B in FIG. 11) are exposed at both end portions in the axial direction of the core body 50.

Figure 11C:
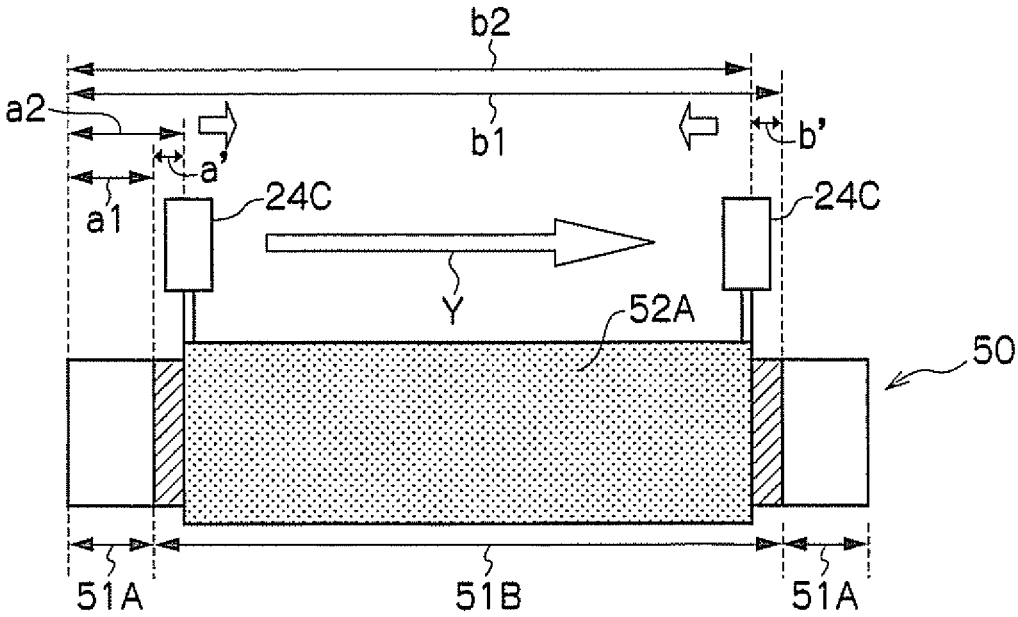
FIG. 11C is a schematic drawing showing a state where the coating film to be formed on the core body is shifted to the central portion in the axial direction of the core body by executing the process routine as shown in FIG. 10.

Further, when the series of the processes are further repeatedly performed, and the releasing property in the regions continuous from the region where the coating film 52A is to be formed is deteriorated, the coating starting position and the coating ending position of the coating film 52A are further changed to the central portion in the axial direction, respectively, such that the regions where the releasing property is not deteriorated are exposed in the regions continuous from both end portions in the axial direction of the coating film 52A. Accordingly, as shown in FIG. 11C, the coating film 52A is formed on the outer peripheral surface of the core body 50 such that the undeteriorated region (undeteriorated region 51B in FIG. 11C) becomes in the state where the undeteriorated regions are exposed at both end portions in the axial direction of the core body 50.

As described in the above, according to the present exemplary embodiment, the cylindrical member manufacturing apparatus 10, when the deterioration of the releasing property of the regions continuous from the region where the coating film 52A to be formed at the inner side from both ends in the axial direction on the outer peripheral surface of the core body 50 is judged, the film-forming section 24 is controlled such that the coating film 52A is formed by exposing the regions having an undeteriorated releasing property on the outer peripheral surface of the core body 50 at both end portions in the axial direction.

Accordingly, the coating film 52A is formed on the outer peripheral surface of the core body 50, and the release of the baked coating film 52A from the core body 50 with ease is maintained over a long period of time so that the undeteriorated regions are always exposed at both end portions of the axial direction of the core body 50.

EXAMPLES

Hereafter, the invention will be described in detail based on exemplary embodiments and comparative examples. However, the invention is not particularly limited thereto.

Example 1

As a core body 50, the stainless steel pipe having an inner diameter Φ of 278 μm, a length of 980 mm, and a thickness of 5.8 mm is prepared, and the outer peripheral surface of the pipe is subjected to a blast processing to form a surface roughness Ra of 0.45 μm. After the surface of the core body 50 is degreased, and coated with a mixed solution of a silicone-based releasing agent (SEPACOAT (trade name) manufactured by Shin-Etsu Chemical Co., Ltd.) and heptane, the coated core body is baked at 420° C. for 2 hours. Furthermore, after the core body 50 is cooled sufficiently, the core body 50 is coated with the above mixed-solution of the releasing agent and heptane is coated once again, and is baked at 330° C. for one hour. In this manner, a releasing layer 51 is formed on the outer peripheral surface of the core body 50 to impart a releasing property, thereby preparing the core body 50 with the releasing property on the outer peripheral surface thereof.

Using the above core body 50, in the cylindrical member manufacturing apparatus 10 as shown in FIGS. 1, 3, 5, 6, 8 and 9, the process routine as shown in FIG. 10 is executed, and the manufacturing process of the cylindrical member is performed.

In addition, in a film-forming section 24, a mixed-liquid formed by dispersing carbon powder in an amount of 80 parts by weight in a PI precursor solution (U-IMIDE (trade name) manufactured by Unitika Ltd.) having a viscosity of 50 Pa·s at a temperature of 25° C. is used as a resin solution 52B. Further, in the film-forming condition in the film-forming section 24, the resin solution 52B is supplied from a nozzle having an inner diameter of 2 mm and a length of 10 mm to the outer peripheral surface of the core body 50 with the use of NEMO Pump (registered trade name, manufactured by HEISHIN Ltd.) as a supply unit 24C. Moreover, the revolving speed of the core body 50 by a rotation drive unit 24A is set to 50 rpm, and the moving speed (movement speed in the axial direction of the core body 50) of the supply unit 24C and the blade 25F by a motor 24B is set to 135 mm/minute.

Further, the coating starting position and the coating ending position in the film-forming section 24 are set to a distance of 55 mm and 925 mm, from one end of the core body 50, respectively. That is, the distance "a" is set to 55 mm, and the distance "b" is set to 925 mm in FIG. 11A. The starting position information and the ending position information are beforehand stored in a memory 30B in correlation with the identification information of the core body 50.

In addition, after a coating film 52A is formed in the film-forming section 24, the core body 50 is allowed to stand at a temperature of 145° C. for 15 minutes in a heating device, while the core body 50 in the horizontal state is being rotated at a speed of 10 rpm by the drive of the rotation drive unit 24A. Thereafter, the temperature is changed to a temperature of 155° C. to further dry the core body 50 for 12 minutes. Moreover, in a baking section 26, the coating film 52A formed from a polyimide resin is baked by heating the core body 50 at temperatures of 200° C., 250° C., 280° C. and 315° C., respectively, for 30 minutes each, by elevating the temperature stepwise.

Further, as a deterioration judgment table, Table 1 is used.

Furthermore, the distances of the coating starting position and the coating ending position to be shifted in the axial direction to the central portion of the core body 50 are set to 3 mm, respectively. That is, the distance a' and the distance b' in FIG. 11B are set to 3 mm. The information is beforehand stored in the memory 30B.

According to Example 1, the process routine as shown in FIG. 10 is executed in the cylindrical member manufacturing apparatus 10 having the above constitution. A series of manufacturing processes including the film-formation of the coating film 52A by coating the resin solution 52B in the film-forming section 24, the heating and baking process in the baking section 26, and the release of the cylindrical member 52 in the releasing section 28 is successively performed 135 times. In each of all the cylindrical members 52 thus manufactured, it is confirmed that the coating film 52A is easily released from the core body 50.

Comparative Example 1

In the process routine as shown in FIG. 10 executed in the cylindrical member manufacturing apparatus 10 in Example 1, the manufacturing process of the cylindrical member is performed in the same conditions as those of Example 1, except that the process routine steps 104-108 are not executed by changing the program so as not to change the coating starting position and the coating ending position.

A series of manufacturing processes including the film-formation of the coating film 52A by coating the resin solution 52B in the film-forming section 24, the heating and baking process in the baking section 26, and the release of the cylindrical member 52 in the releasing section 28 is successively performed 135 times.

In each of the cylindrical members 52, it is confirmed that the coating film 52A is easily released from the core body 50 thus manufactured in the processes from one to 49 times. However, in the cylindrical members 52 manufactured in the processes after 50 times, the coating film 52A cannot be released from the core body 50 due to the sticking of the coating film 52A to the outer peripheral surface of the core body 50.

What is claimed is:

1. An apparatus for manufacturing a cylindrical member, the apparatus comprising:

a cylindrical core body having a releasing layer coated over an entire outer peripheral surface of the core body;

a film-forming device configured to form a resin film in a central region of the releasing layer, the central region being located at a central portion from both ends in the axial direction of the outer peripheral surface of the core body;

a judging device configured to judge, based upon a number of times of manufacturing the cylindrical member, a releasing property of outer regions of the releasing layer, the outer regions being continuous from the central region where the resin film is to be formed to both ends in the axial direction of the outer peripheral surface of the core body, before the resin film is formed by the film-fanning device; and a control device that receives the results of the judgment by the judging device and is programmed to control the film-forming device so that the resin film is formed by exposing regions of the releasing layer on both ends in the axial direction of the outer peripheral surface of the core body, and is programmed to control a coating starting position and a coating ending position depending on the judgment results, wherein the releasing property is determined by comparing the number of times of manufacturing to a predetermined value; and if the releasing property is judged to be deteriorated, the coating starting and ending positions are shifted increasingly towards the central portion of the core body as the number of times of manufacture increases.

2. The apparatus for manufacturing a cylindrical member according to claim 1, wherein the control device is configured to control the film-forming device such that the exposed regions of the releasing layer on the outer peripheral surface of the core body are exposed on both ends of the resin film to be formed in the axial direction when the releasing property of the outer regions of the releasing layer is judged by the judging device.

3. The apparatus for manufacturing a cylindrical member according to claim 1, wherein the film-forming apparatus further comprises:

a rotation device configured to rotate the core body in the circumferential direction;

a supply device configured to supply a thermosetting resin to the outer peripheral surface of the core body rotated by the rotation device; and a moving device configured to relatively move at least one of the supply device or the core body in the axial direction of the core body.

4. The apparatus for manufacturing a cylindrical member according to claim 3, wherein the exposed regions of the releasing layer on the outer peripheral surface of the core body are exposed on both ends of the resin film to be formed in the axial direction of the core body.

5. The apparatus for manufacturing a cylindrical member according to claim 1, further comprising an identification plate configured to identify the cylindrical core body.

* * * * *